United States Patent [19]

Nervig et al.

[11] Patent Number: 4,678,086

[45] Date of Patent: Jul. 7, 1987

[54] PAGE TYPE DISPLAY FIXTURE WITH SELF RETURN FEATURE

[75] Inventors: Charles H. Nervig, Berea; Vance E. Dimmick, Strongsville, both of Ohio

[73] Assignee: American Greeting Corporation, Cleveland, Ohio

[21] Appl. No.: 656,354

[22] Filed: Oct. 1, 1984

[51] Int. Cl.[4] ..... A47F 7/16

[52] U.S. Cl. ..... 211/47; 211/169

[58] Field of Search ..... 211/47, 48, 169; 248/145, 417; 49/236, 237; 40/605, 530, 534

[56] References Cited

U.S. PATENT DOCUMENTS

| | | | |
|---|---|---|---|
| 696,341 | 3/1902 | Johnson | 211/48 |
| 1,688,255 | 10/1928 | Wasch . | |
| 3,000,113 | 9/1961 | Olson . | |
| 3,017,999 | 1/1962 | Cano | 211/169 X |
| 3,113,649 | 12/1963 | Wargo . | |
| 3,200,958 | 8/1965 | Hudgeons, Sr. et al. . | |
| 3,351,211 | 11/1967 | Best . | |
| 3,378,881 | 4/1968 | Hentzi et al. . | |
| 3,391,796 | 7/1968 | Cross . | |
| 3,398,487 | 8/1968 | Matyas . | |
| 3,478,893 | 11/1969 | Crosslen | 211/169 X |
| 3,546,736 | 12/1970 | Booth . | |
| 3,714,736 | 2/1973 | Weaver | 49/237 |
| 3,777,896 | 12/1973 | Ehrlich . | |
| 3,982,633 | 9/1976 | Pennington | 211/169 X |
| 4,030,219 | 6/1977 | Donovan | 40/605 |

FOREIGN PATENT DOCUMENTS

| | | | |
|---|---|---|---|
| 417637 | 6/1910 | France | 49/237 |
| 607446 | 8/1948 | United Kingdom | 49/237 |
| 817116 | 7/1959 | United Kingdom | 211/169 |

*Primary Examiner*—Robert W. Gibson, Jr.
*Assistant Examiner*—Sarah A. Lechok
*Attorney, Agent, or Firm*—Baldwin, Egan, Hudak & Fetzer

[57] ABSTRACT

A display fixture for displaying articles (e.g. carpeting, linoleum, tile or wall covering samples or the like) comprising a base frame having a series of generally side-by-side swingable page members thereon for supporting the articles to be displayed, with each page member being pivotally mounted for swinging movement on the base frame in a generally horizontal plane and with respect to generally vertically spaced pivots on the base frame. The lower one of each pair of pivots, and its associated page member, has a gravity actuated self return means for causing the page member to automatically move into a predetermined reposed position with respect to the base frame and the adjacent page members of the series. The self return means may be expeditiously formed of plastic and preferably comprises a series of spaced, upward sloping helical-like camming surfaces mounted on an elongated base, with each such camming suface being adapted to coact with a plastic rider section on the underside of an associated page member, for providing self return to a series of the generally side-by-side page members.

19 Claims, 13 Drawing Figures

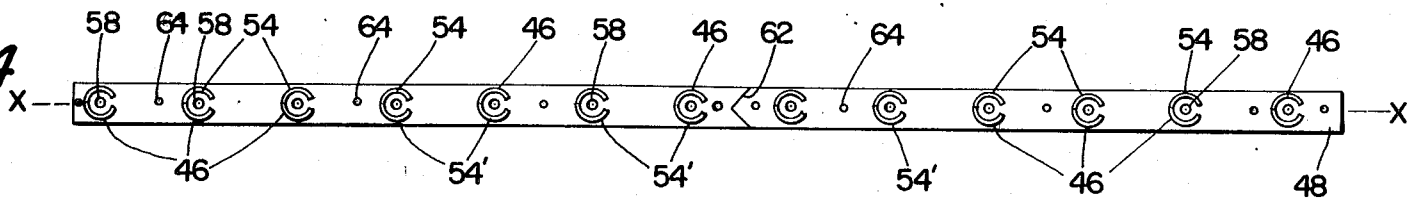
Fig. 4
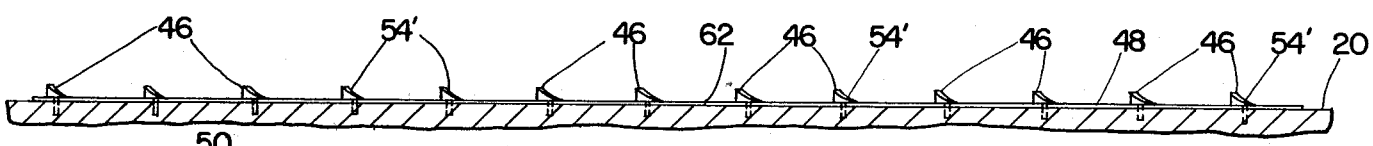
Fig. 5
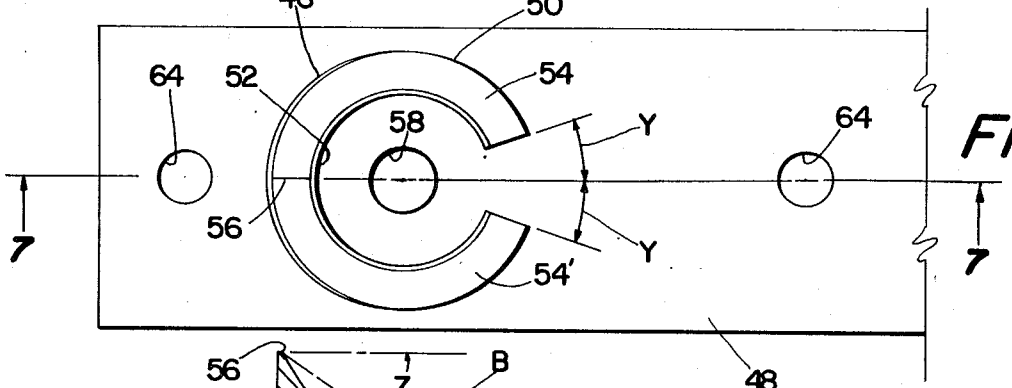
Fig. 6
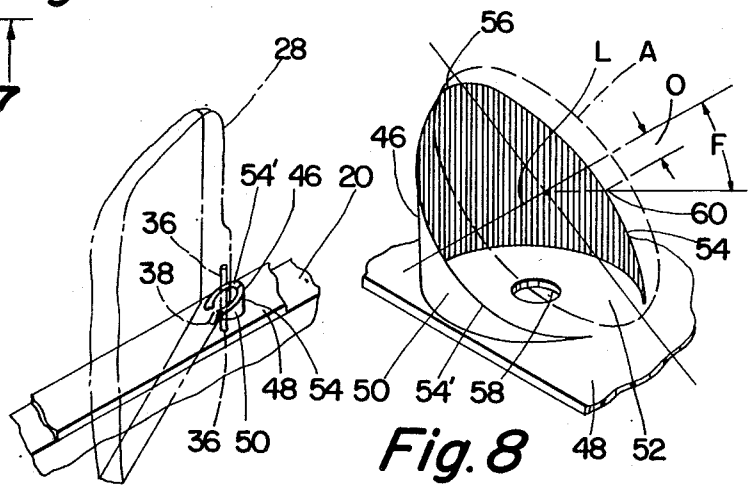
Fig. 8
Fig. 13
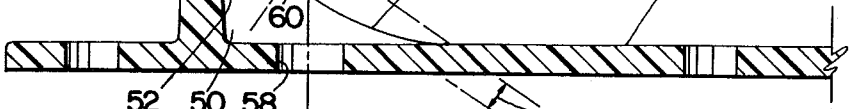
Fig. 7

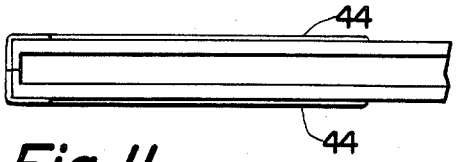
Fig. 11
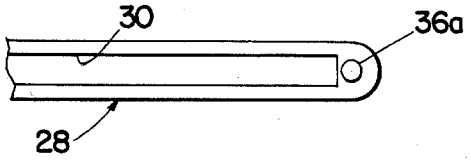
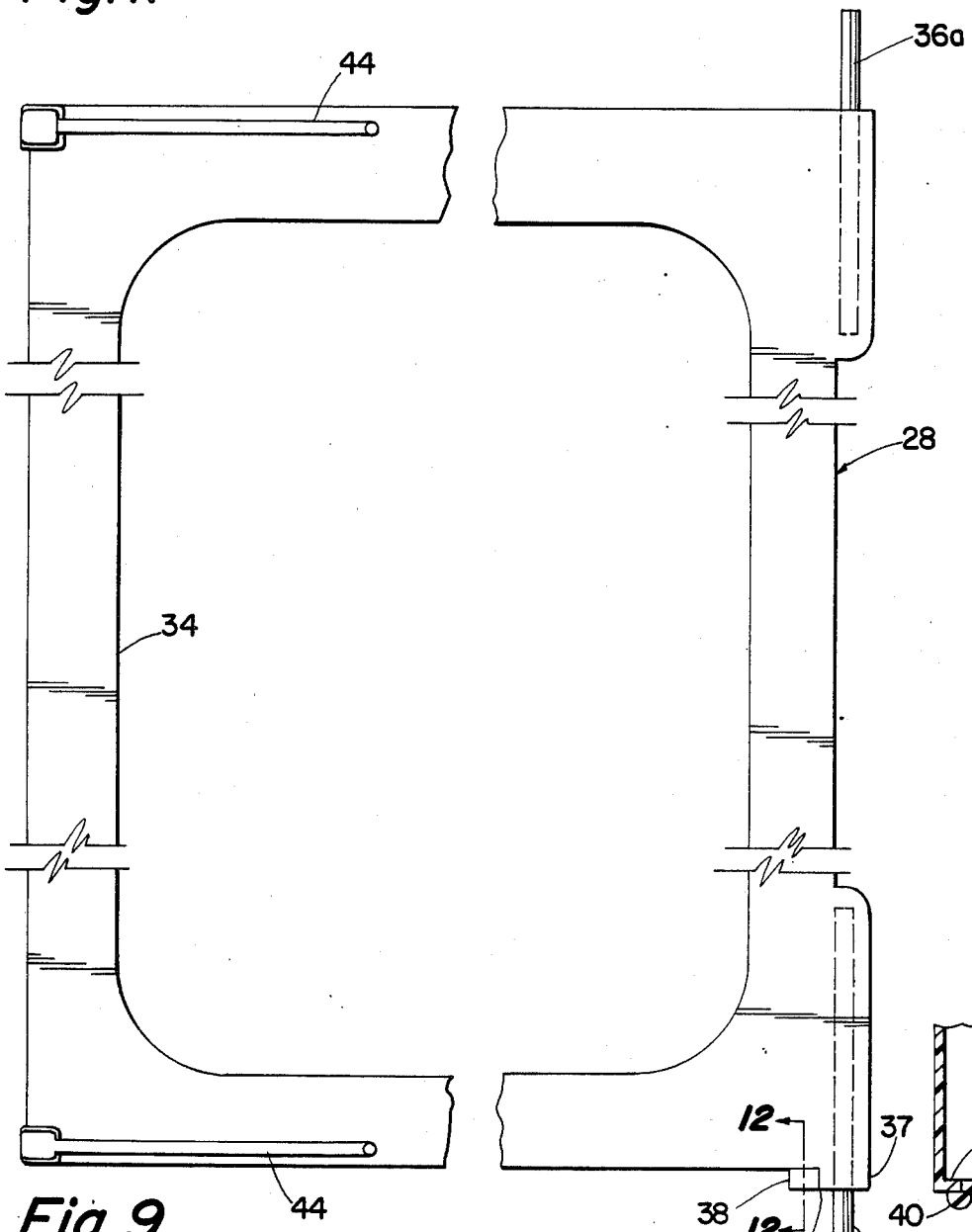
Fig. 9
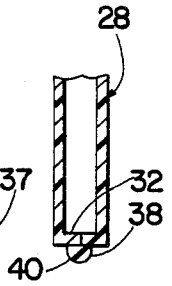
Fig. 12
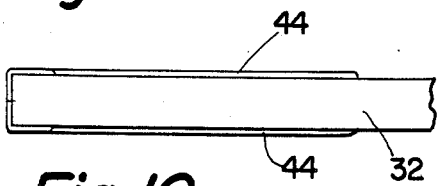
Fig. 10
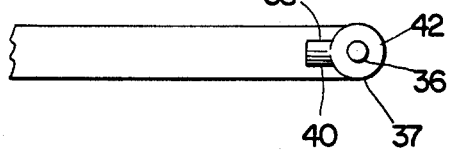

PAGE TYPE DISPLAY FIXTURE WITH SELF RETURN FEATURE

This invention relates in general to a display fixture for exhibiting or displaying articles, such as for instance floor or wall covering samples (e.g. carpeting samples or wallpaper samples or linoleum samples and the like) and more particularly relates to a display fixture formed of a series of generally side-by-side swingable page members mounted on a base frame for pivotal movement in a generally horizontal plane, with such page members having a self return feature, so that they automatically return to predetermined reposed position with respect to the base frame and the adjacent page members, and also allowing visibility and access for photos or literature or the like, mounted adjacent to but laterally of the side-by-side page series of the fixture.

BACKGROUND OF THE INVENTION

Leaf or page display fixtures are well known in the prior art. To applicants' knowledge, such page display fixtures were heretofore of the type that did not embody any self return feature therewith so that the appearance of the display, if it was of the type where the pages or leaves were mounted for swinging movement about a generally vertical axis and in a generally horizontal plane, was not generally maintained in an orderly condition upon use of the display by the public. A customer perusing through the pages of a display ordinarily may not place the pages back into an orderly condition when he or she is through looking at the display specimens mounted on the swingable pages.

SUMMARY OF THE INVENTION

The present invention provides a display fixture wherein the swingable pages of the fixture are mounted for pivotal movement in a generally horizontal plane for supporting articles for display purposes, and with there being provided self return means coacting with each of the pivots of the pages so that the series of generally side-by-side pages are urged by gravity into an orderly predetermined position with respect to the base frame of the fixture and with respect to the adjacent page members of the series. The page members may be oriented so as to be urged toward or to the left, or toward or to the right of a vertical plane disposed generally perpendicular to the front of the display, and the self return means of the invention is preferably a "universal part" which means it can be used to direct the pages or leaves of the display fixture either to the right or to the left, depending upon the desires of the designer of the display fixture.

Accordingly, an object of the invention is to provide a novel display fixture comprising a series of generally side-by-side swingable leaf or page members, each having means thereon for supporting an article or articles for display purposes, and including gravity actuated self return means coacting with the page members for urging the latter to a predetermined reposed position on the fixture.

Another object of the invention is to provide a fixture of the aforementioned type, wherein the self return means is formed of plastic and comprises an inclined generally helical upwardly extending camming surface coacting with the lower pivot of a page member and with the latter including a rider section on the underside thereof spaced from the pivotal axis of the page member and adapted for camming engagement with said camming surface, whereby the respective page member is urged by gravity into predetermined reposed position on the base frame of the fixture.

A still further object of the invention is to provide a gravity actuated self return mechanism for a swingable page member of a display fixture, with such page member being adapted for supporting an article or articles for display purposes, and comprising an arcuate shaped, in plan, bearing member having an inclined generally helical upwardly extending camming surface thereon, and with a rider section on the underside of the page member, spaced from the pivotal axis of the page member and adapted for camming engagement with the camming surface on the bearing member, for urging the page member to predetermined reposed position.

A still further object of the invention is to provide a series of the above described bearing members mounted on an elongated base and with such bearing members being spaced generally uniform distances relative to one another, lengthwise of the base, with the camming surface of each said bearing member being adapted for camming coaction with a rider section of a respective page member, and wherein the series of bearing members on the elongated base and the rider section on the pages being formed of molded plastic.

Other objects and advantages of the invention will be apparent from the following description taken in conjunction with the accompanying drawings wherein:

BRIEF DESCRIPTION OF THE DRAWINGS

FIG. 4 is a top plan view of a plurality of the automatic return oearing members mounted on or secured to an elongated base, for pivotally, supporting the generally side-by-side pages of a series of the pages of a display fixture;

FIG. 5 is a side elevational view of the automatic return bearing structure illustrated in FIG. 4, and with such structure being mounted on a horizontal support, for swingably supporting the pages thereon;

FIG. 6 is a greatly enlarged top plan view of one of the automatic self return bearing members of the structure illustrated in FIGS. 4 and 5;

FIG. 7 is a vertical sectional view taken generally along the plane of line 7—7 of FIG. 6 looking in the direction of the arrows;

FIG. 8 is a diagrammatic illustration of the relationship between an imaginary oblique plane passing through the terminus of the inclined generally helical upwardly extending camming surfaces on the self return bearing member and the mergence of such camming surfaces with the bottom or base wall of the bearing article;

FIG. 9 is a vertically and horizontally broken side elevational view of one of the pages adapted for mounting articles thereon for display purposes, and illustrating adjacent the bottom pivot thereof the rider section which is adapted for camming engagement with the camming surface on the respective self return bearing member of FIGS. 4 through 8;

FIG. 10 is a broken bottom plan view of the page of FIG. 9;

FIG. 11 is a broken, top plan view of the page of FIG. 9;

FIG. 12 is a vertical sectional view taken generally along the plane of line 12—12 of FIG. 9 looking in the direction of the arrow, and illustrating the arcuate configuration of the exterior surface of the rider section of the self return mechanism on the page; and FIG. 13 is a diagrammatic illustration of one of the page frames of FIGS. 9 through 12 as mounted on a self return bearing member of FIGS. 6 and 7, and as urged into a generally reposed position by such self return mechanism.

DESCRIPTION OF PREFERRED EMBODIMENT

Figures 1, 2, 3:
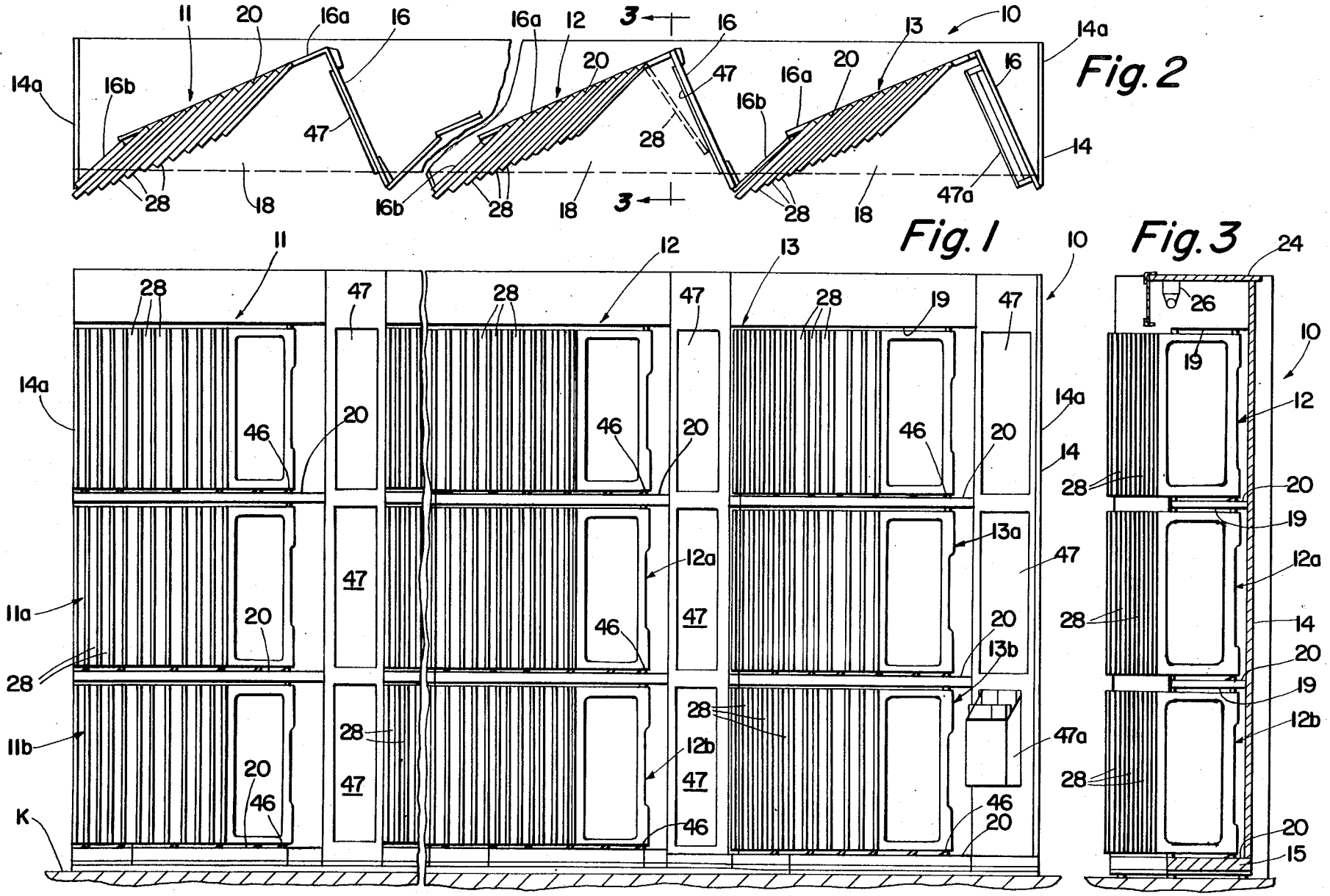
FIG. 1 is a generally broken, front elevational, generally diagrammatic view of a display fixture embodying the invention and having a plurality of series of generally side-by-side pages adapted for displaying articles thereon, and mounted for swinging movement in a generally horizontal planes.
FIG. 2 is a generally diagrammatic, broken plan view of the display fixture of FIG. 1, with the top or cap thereof having been removed to illustrate the side-by-side reposed position of the pages of the fixture; in phantom lines there is illustrated one of the pages of the central series of pages having been swung to open position, for more fully exposing the next adjacent page.
FIG. 3 is a sectional view taken substantially along the plane of line 3—3 of FIG. 2, looking in the direction of the arrows.

Referring now particularly to FIGS. 1 through 3 of the drawings, there is illustrated a display fixture of the page or leaf type, with the article displaying pages thereof being mounted for swinging movement in generally horizontal planes, and embodying the gravity actuated self return feature of the invention, so that an orderly appearance of the display is maintained and wherein the pages are urged into predetermined reposed condition with respect to the base frame of the display fixture, allowing generally constant visibility and access to other areas of the display fixture for mounting other exhibits and marketing articles adjacent to and laterally of the side of each assembly of a series of the pages.

The display fixture 10 comprises in the embodiment illustrated a plurality of series 11, 11*a*, 11*b*, 12, 12*a*, 12*b* and 13, 13*a*, 13*b* of display pages, with such series being disposed in generally vertical spaced orientation and also in the embodiment illustrated, in horizontally spaced relation, on a base frame 14 which is adapted in the embodiment illustrated, to be supported on a surface, such as for instance a floor surface K.

The base frame 14 may include side panels 14*a*, a bottom wall panel 15 and zigzag back panels 16, 16*a*, 16*b*. Panels 16, 16*a*, 16*b* are, in the embodiment illustrated, angularly disposed with respect to one another, forming recessed cubicles 18, opening onto the front of the display fixture.

Panels 16*a* may have vertically spaced openings 19 formed therein, providing on the bottom defining edges thereof horizontal support bars or surfaces 20 adapted for pivotally supporting thereon the respective series 11–11*b*; 12–12*b* or 13–13*b* of pages, which are adapted to display articles, such as for instance floor or wall covering samples, or the like. In the embodiment illustrated there are three series of pages in each column of the fixture, each received in its respective cubicle 18 formed in the base frame.

The display fixture may include a cap portion 24 which can also have lighting means 26 associated therewith, for illuminating the various displays of articles carried by each of the respective series of pages.

Referring now in particular to FIGS. 9 through 12, each of the pages 28 of the display comprises, in the embodiment illustrated, an envelope which is open at the top thereof, as at 30, and into which the specimen or sample to be displayed may be inserted. The page 28 is preferably closed on the bottom thereof as at 32 (FIG. 10) so that the specimen or sample will not pass through the envelope body of the respective page.

The page may have a generally centrally located opening 34 therethrough which thus expeditiously provides for visual examination of the specimen supported on the respective page between the boundary walls thereof. The page 28 preferably has a projecting bottom pivot or post 36 mounted thereon and also a top pivot or post 36*a*, so that the respective page can be pivoted to the base frame for swinging movement in a generally horizontal plane as a customer peruses through the pages to examine the samples mounted thereon. Pivot 36 preferably extends below the bottom boundary of the page, and pivot 36*a* preferably extends upwardly above the top boundary of the page and as illustrated in FIG. 9. The bottom pivot 36 extends below a generally cylindrical or circular boss 37 formed on the bottom surface of the respective page.

Projecting laterally inwardly from boss 37 is a rider portion or section 38 of the self return feature, which as can be best seen in FIG. 12 is preferably of arcuate configuration on the bottom thereof, as at 40 (FIG. 12) for a purpose to be hereinafter described. The bottommost level of surface 40 is preferably coplanar with the generally flat bottom surface 42 of boss 37 surrounding pivot post 36.

The pages 28 may have bumper portions 44 formed integrally therewith and in the embodiment illustrated on both the top and bottom portions thereof. The pages may be and preferably are formed of molded plastic material, many types of which are well known in the art for such purposes. An example of one type of plastic material which would be suitable for molding the relatively rigid page frame is polypropylene which can be furnished in any desired color.

Referring now in particular to FIGS. 4 through 8 and 13, associated with each page 28 on the fixture frame is a self return bearing structure 46, so that each page will automatically return to a predetermined reposed position with respect to the base frame upon release from an outwardly swung position, thus maintaining the orderliness of the display when a customer is finished leafing through the various pages, to view the articles of merchandise mounted on the respective pages. As can be seen in FIGS. 2 and 13, in the embodiment illustrated, the pages in their reposed condition are disposed obliquely with respect to the aforementioned respective support surface 20. In the embodiment illustrated, the pages of each of all of the series thereof are set up to be oriented in the same oblique direction, with respect to the base frame when in their reposed positions.

In such reposed positions of the pages, the panels or walls 16 of the fixture are maintained in unobstructed condition, and thus can be readily utilized to mount other illustrations or specimens, as for instance those represented by the rectangular blocks 47 in FIG. 2, as well as receptacles 47*a* adapted for holding and furnishing other literature or the like to a prospective customer utilizing or perusing through the display.

In the embodiment illustrated, a plurality of the bearing structures 46 are preferably provided as mounted on an elongated base 48, so that one or more of the elongated strips of bearing and base structure can be readily mounted on the associated horizontal support surface 20 of the display fixture thus providing for rapid and effective provision of a plurality of self return bearing members in conjunction with each of the pivotally mounted pages 28 of each series thereof.

The elongated strips of bearing structure 46 and base 48 can be readily formed as a unitary article from molded plastic materials, such as the aforementioned polypropylene or from any other suitable plastics, such as polystyrene, which will provide good bearing self return properties to the pages 28.

As can be best seen in FIGS. 6 and 7, each bearing member 46 comprises an arcuate shaped (in plan) side wall portion 50 defining a socket 52 with the side wall portion 50 on the top surface thereof including an inclined generally helical upwardly extending camming surface 54, which commences at its mergence with the base 48 and extends upwardly to a terminus 56, which in the embodiment illustrated is disposed in a vertical plane passing through and coextensive with the lengthwise axis X—X of the base 48. In the embodiment illustrated, a pair of such upwardly extending camming surfaces is provided, with the other surface 54' commencing at approximately the same location, in spaced relationship to the aforementioned axis of base 48, and extending generally helically upwardly to abut the first mentioned camming surface 54 at terminus 56.

The purpose of a pair of such camming surfaces is to provide for utilization of the bearing-base structure 46, 48 for either righthand or lefthand orientation of the pages. Thus it will be understood that only one camming surface 54 or 54' is utilized at a time with each page 28 to provide for automatic gravity actuated self return of the page from a horizontally swung position back to its reposed position. Such maximum outward horizontally swung position of a page, as can be seen in dotted lines in FIG. 2, may be limited by engagement of the outwardly swung page with the adjacent side panel 16, or with the adjacent page after the first page of a series is swung outwardly.

In the embodiment illustrated, the mergence of the respective camming surface 54 or 54', with the base 48 occurs at an angle Y of approximately 20° from the lengthwise axis of base 48, and a vertical plane passing through the vertical axis of the centrally located through opening 58 in the base 48, disposed generally centrally of the respective socket 52. Opening 58 is adapted to receive therethrough in rotatable relation the bottom pivot post 36 of the respective page member and pivotally mount the lower end of the respective page member for horizontal swinging movement. The top pivot post **36*a* of the respective page is adapted for pivotal mounting in a complementary opening in back panel support 16*a*, and spaced vertically from opening 58. The arcuate side wall 50 of the respective camming surface 54 or 54' is preferably tapered inwardly in an upward direction, and as can be best seen in FIGS. 6 and 7. The aforementioned socket 52 is adapted to receive the hub portion 37 of the respective page member in the reposed position of the page member on the base frame of the fixture; as the page member is manually swung or rotated with respect to its respective self return bearing member 46, the hub portion 37 and associated page member moves upwardly, with the rider section 38 engaging on its arcuate underside the respective camming surface 54 (or 54') of the bearing portion 46. Clearance is provided in support panel 16*a*, as can be seen in FIGS. 1 and 3**, to accommodate such upward movement of the pages as they are swung outwardly.

Referring now to FIG. 8 in conjunction with FIGS. 6 and 7, there is illustrated diagrammatically a preferred arrangement for formation of the self return camming surface on each of the bearing members 46 for effecting optimum self return in conjunction with the display pages illustrated. Such right and left camming surfaces 54, 54' each has a slope as illustrated in FIGS. 7 and 8. An imaginary oblique plane A passing generally through the terminus 56 and through the mergence of the camming surfaces 54, 54' with said bottom wall or base portion 48 is preferably disposed at an angle Z (FIG. 7) of approximately 35° with respect to a horizontal plane passing through terminus 56, and the mergences of said camming surfaces 54, 54' with the bottom wall portion or base 48 occurs at locations spaced generally evenly from a vertical plane passing through the vertical axis of opening 58 and the terminus 56, and as can be best seen in FIG. 6. An imaginary transverse plane B (FIG. 7) extending perpendicular to said vertical plane through axis X—X and generally perpendicular to the oblique plane A, at the point of intersection of the vertical axis of opening 58 and oblique plane A, intersects the camming surfaces at locations 60 which are each preferably at an approximately 20° angle F from a line L disposed in the perpendicular transverse plane B and the oblique plane A. Points 60 are at a predetermined dimension 0 from the oblique plane A, and in the embodiment illustrated at a dimension of preferably approximately 0.156 inch.

As can be seen in FIGS. 4 and 5, a pair of the molded plastic plural self return bearing-base member assemblies may be joined to one another to provide a longer length, and an effective way of doing this in a display fixture unit is to notch the adjacent ends as at 62, so as to interlock such ends together. Also each base 48 in the embodiment illustrated, is preferably provided with a plurality of openings 64 therethrough, for attaching the molded plastic bearing-base structure to the associated horizontal support surface 20 on the display fixture frame, and as by means of conventional fasteners.

From the foregoing description and accompanying drawings, it will be seen that the invention provides a novel display fixture comprising a base frame with a series of generally parallel side-by-side swingable page members, with each having means thereon for supporting an article for display purposes, and with each of the page members being pivotally mounted for swinging movement on the base frame in a generally horizontal plane, and with respect to respective generally vertically spaced pivots on said base frame. The lower one of each pair of said pivots has self return means for causing each page member to automatically move by gravity toward or to a predetermined reposed position with respect to the base frame and with respect to the adjacent page members, and wherein the self return means comprises an inclined generally helical upwardly extending camming surface coacting with the lower pivot and wherein the page members each includes a rider section spaced from the pivotal axis of the page member and which is adapted for camming engagement with said camming surface whereby the respective page member is urged into said predetermined reposed position with respect to the base frame and with respect to the other page members of a series of pages.

The invention also provides a self return bearing structure of the aforementioned type which can be formed of molded plastic material so as to provide a plurality of such bearing structures for ready attachment to a display fixture frame, thus providing a unitary article having plural self return means for expeditious use with a series of the swingable display pages of the fixture.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. A display fixture comprising a base frame, a series of generally side-by-side swingable page members, each having means thereon for supporting an article for display purposes, each of said page members being pivotally mounted for swinging movement on said base frame in a generally horizontal plane and with respect to respective gnerally vertically spaced pivots on said base frame, the lower one of each pair of said pivots having self return means for causing each said page member to automatically move by gravity into a predetermined reposed position with respect to said base frame and with respect to the adjacent page members, said reposed position being one wherein the respective page member is disposed at a predetermined acute angle with respect to a generally vertical plane passing through said lower pivots of said series of page members, and wherein said self return means comprises a generally forizontal base section and a pair of inclined, generally helical upwardly extending camming surfaces coacting with each said lower pivot in generally surrounding relation with the respective lower pivot, and the respective of said page members includes a rider section spaced from the pivotal axis of the page member and which is adapted for camming engagement with one of the respective said pair of camming surfaces whereby said respective page member is urged into aid predetermined reposed position with respect to said base frame and with respect to the other page members of said series, said surfaces at their lower ends commencing at said base section in generally equal laterally spaced relation to said vertical plane and curving smoothly upwardly from said base section and in the general direction of said vertical plane, whereby when each of said page members are automatically urged to said reposed position, said rider section of the respective page member is disposed at said lower end of the respective said one surface, said self return means being utilizable for either right hand or left hand orientation of a respective series of said page members.

2. A fixture in accordance with claim 1 wherein said series of said camming surfaces of said self return means are mounted on an elongated generally planer rectangular-like shaped in plan base comprising said base section and are spaced generally uniform distances relative to one another lengthwise of said base, said base being mounted on said base frame with the lengthwise axis of said base disposed in said vertical plane, each said one camming surface of each said respective pair being adapted to coact with a respective page member, the latter comprising a vertical center plane passing through said pivotal axis, said rider section being disposed in said vertical center plane of the respective page member and projecting radially with respect to said pivotal axis of the respective page member.

3. A fixture in accordance with claim 1 wherein said camming surfaces and associated rider section of each said respective page member are formed of plastic material.

4. A display fixture in accordance with claim 2 wherein said series of camming surfaces of said self return means and said elongated base are formed as a unit of molded plastic.

5. A fixture in accordance with claim 1 wherein said rider section comprises a generally arcuate downwardly facing exterior surface adapted for engaging the respective camming surface.

6. A display fixture comprising a base frame, a series of generally side-by-side swingable page members, each having means thereon for supporting an article for display purpose, each of said page members being pivotally mounted for swinging movement on said base frame in a generally horizontal plane and with respect to respective generally vertically spaced pivots on said base frame, the lower one of each pair of said pivots having self return means for causing each said page member to automatically move by gravity into a predetermined reposed position with respect to said base frame and with respect to the adjacent page members, said reposed position being one wherein the respective page member is disposed at a predetermined acute angle with respect to a generally vertical plane passing through said lower pivots of said series of page members, and wherein said self return means comprises a generally horizontal base section and an inclined, generally helical upwardly extending camming surface coacting with said lower pivot, and the respective of said page members includes a rider section spaced from the pivotal axis of the page member and which is adapted for camming engagement with said camming surface whereby said respective page member is urged into said predetermined reposed position with respect to said base frame and with respect to the other page members of said series, said surface at its lower end commencing at said base section in laterally spaced relation to said vertical plane and curving smoothly upwardly from said base section and in the general direction of said vertical plane, whereby when each of said page members is automatically urged to said reposed position, said rider section of the respective page member is disposed at said lower end, said series of said camming surfaces of said self return means are mounted on an elongated generally planar rectangular-like shaped in plan base comprising said base section and are spaced generally uniform distances relative to one another lengthwise of said base, said base being mounted on said base frame with the lengthwise axis of said base disposed in said vertical plane, each said camming surface being adapted to coact with a respective page member, the latter comprising a vertical center plane passing through said pivotal axis, said rider section being disposed in said vertical center plane of the respective page member and projecting radially with respect to said pivotal axis of the respective page member, said series of camming surfaces of said self return means and said elongated base being formed as a unit of molded plastic, and wherein said base frame includes a vertical frontal plane and comprises a plurality of spaced vertically extending supports, certain of said supports abutting at a vertically extending juncture and said certain supports are oriented obliquely with respect to one another to define a recessed section in said base frame opening to said frontal plane of said base frame, said elongated base and associated series of plastic camming surfaces of said self return means being mounted generally horizontally on one of said certain supports in said recessed section with said series of page members being mounted on said elongated base and being urged by said camming surfaces of said self return means into said predetermined reposed positions with respect to said base frame and in said recessed section thereof, each said page member including upwardly and downwardly projecting top and bottom pivot posts received in the respective of said pivots on said base frame for pivotally mounting the respective page member on said base frame, each said page member at the vertical pivotal axis of said bottom post including a circular boss with said rider section projecting generally radially outwardly from said boss and in general axial alignment with said vertical center plane of the respective page member, and each said camming surface commencing at said base section in said laterally spaced relation at an angle of approximately 20° from the first mentioned vertical plane, and with respect to a horizontal line passing through the pivotal axis of said bottom post and the commencement of said camming surface at said base section, said boss having a generally flat bottom surface, and the bottom surface of said rider section being arcuate in configuration to define a generally semi-cylindrical surface which semicylindrical surface at its bottommost level is generally coplanar with said flat bottom surface of said boss.

7. A fixture in accordance with claim 6 wherein the other of said certain supports defining said recessed section is adapted to limit the horizontal pivotal movement of said page members by engagement therewith to stop further swinging movement thereof in one pivotal direction.

8. A fixture in accordance with claim 1 including a plurality of vertically spaced series of said swingable page members mounted on said base frame, each page member of each said vertically spaced series comprising said rider section and coating with a respective camming surface on said base frame for urging said page members of each series into said predetermined reposed position with respect to said base frame and the adjacent page members of the respective series.

9. A fixture in accordance with claim 1 said camming surfaces of each said pair intersect at their upper ends at a common level.

10. A gravity actuated self return for a swingable page member of a display fixture, with such page member being adapted for supporting an article for display purposes, and being adapted for swinging movement in a generally horizontal plane and with respect to vertically spaced pivots, comprising an elongated base adapted for mounting in a generally horizontal plane and a generally arcuate shaped, in plan, bearing member projecting upwardly from said base and having on the top thereof a pair of inclined generally helically upwardly extending camming/surfaces thereon, and a rider section on the underside of the page member, spaced from the pivotal axis of the page member adapted for camming engagement with one of said pair of camming surfaces for urging the page member to a predetermined reposed angular position with respect to said base, each of said camming surfaces at its lowermost end merging smoothly with said base in generally equal laterally spaced relation to the longitudinal vertical center plane of said base and curving smoothly upwardly from said lowermost end and in the general direction of the last mentioned center plane, whereby when the page member is urged by gravity to its reposed position, said rider section of the page member will be disposed at said lowermost end of said one camming surface and at an acute angle with respect to said last mentioned center plane, said camming surfaces intersecting at their upper ends at a common level and at said last mentioned center plane, said self return being utilizable for either right hand or left hand orientation of the page member.

11. A self return in accordance with claim 10 wherein said rider section is of generally arcuate exterior configuration at the area of engagement with said camming surface to define a generally semi-cylindrical bottom surface therefor projecting from the pivotal axis of the page member.

12. A self return in accordance with claim 10 wherein said rider section is an elongated projecting portion oriented generally radially with respect to the pivotal axis of the page member to define a generally semi-cylindrical configuration in side elevation and presenting in transverse vertical section an arcuate bottom surface on said rider section.

13. A self return in accordance with claim 12 wherein said bearing member partially defines a socket including a bottom wall portion comprising said base and an arcuate generally upstanding side wall portion, with said helically upwardly extending camming surfaces being located on the top of said side wall portion, said camming surfaces extending upwardly from said bottom wall portion to a terminus located at the uppermost level of said wall portion, said bottom wall portion having an opening therein generally centrally located with respect to said socket, said opening adapted to receive a lower pivot post of the respective page member for pivotal movement therein, and said socket being of a diameter adapted to receive therein a complementary sized hub portion of the page member for generally guiding the pivotal movment of the page member relative to said socket.

14. A self return in accordance with claim 10 wherein a series of said bearing members are mounted on said base and are spaced generally uniform distances relative to one another lengthwise of said base, said one camming surface of each said bearing member being adapted for camming coaction with a rider section of a respective page member.

15. A self return in accordance with claim 14 wherein said series of bearing members and said elongated base are formed of molded plastic material.

16. A self return in accordance with claim 13 wherein an imaginary oblique plane passing through said terminus and through the mergence of each said camming surface with said bottom wall portion is disposed at an angle of approximately 35° with respect to a horizontal plane passing through said terminus.

17. A self return in accordance with claim 16 wherein said last mentioned center plane, the passes through the vertical axis of said opening (58) and through said terminus (56), an imaginary transverse plane (B) extending perpendicular to said last mentioned center plane and to said oblique plane (A) at the point of intersection of the vertical axis of said opening (58) and said oblique plane (A) intersecting each said camming surface (54, 54') at a location (60) which is at an approximately 20° angle (F) from a line (L) disposed in said perpendicular transverse plane (B) and said oblique plane (A) and a straight line passing through said location (60) and the point of intersection of said vertical axis of said opening (58) and said oblique plane (A), each of said mergences being spaced laterally of said last mentioned center plane at an angle (Y) of approximately 20° defined by said last mentioned center plane and a line passing through the respective mergences and said vertical axis of said opening.

18. A self return in accordance with claim 15 wherein said elongated base and said series of bearing members are formed as a molded plastic unitary member, and said base having a plurality of spaced openings therein for attaching said unitary member to a support for mounting an associated series of swingable page members thereon.

19. A fixture in accordance with claim 6 wherein said unitary molded plastic self return means and elongated base is formed as a pair of separate units with notch means on adjacent ends of the last mentioned units disposed in coacting relation for interlocking the latter together in their mounted condition on said base frame.

* * * * *

UNITED STATES PATENT AND TRADEMARK OFFICE

CERTIFICATE OF CORRECTION

PATENT NO. : 4,678,086

DATED : July 7, 1987

INVENTOR(S) : Charles H. Nervig; Vance E. Dimmick

It is certified that error appears in the above—identified patent and that said Letters Patent is hereby corrected as shown below:

Column 7: line 21, "gnerally" should read --generally--.

line 32, "forizontal" should read --horizontal--.

line 40, "aid" should read --said--.

Column 10: line 57, after "plane" delete " , the" .

Signed and Sealed this

Fifteenth Day of December, 1987

*Attest:*

DONALD J. QUIGG

*Attesting Officer*

*Commissioner of Patents and Trademarks*